US007710323B2

(12) United States Patent
Boyanov et al.

(10) Patent No.: US 7,710,323 B2
(45) Date of Patent: May 4, 2010

(54) FLAT MOBILE ANTENNA SYSTEM

(75) Inventors: Victor Boyanov, Sofia (BG); Borislav Marinov, Sofia (BG); Stanimir Kamenopolski, Sofia (BG); Mariya Popova, Sofia (BG); Ivaylo Slavkov, Sofia (BG); Georgi Lyubenov, Sofia (BG); Rossen Traykov, Sofia (BG)

(73) Assignee: Raysat Cyprus Limited, Nicosia (CY)

( * ) Notice: Subject to any disclaimer, the term of this patent is extended or adjusted under 35 U.S.C. 154(b) by 1112 days.

(21) Appl. No.: 10/548,088

(22) PCT Filed: Mar. 8, 2004

(86) PCT No.: PCT/BG2004/000003

§ 371 (c)(1),
(2), (4) Date: Sep. 6, 2005

(87) PCT Pub. No.: WO2004/079861

PCT Pub. Date: Sep. 16, 2004

(65) Prior Publication Data

US 2008/0129624 A1 Jun. 5, 2008

(30) Foreign Application Priority Data

Mar. 6, 2003 (BG) ..... 107620

(51) Int. Cl.
*H01Q 1/38* (2006.01)
*H01Q 1/24* (2006.01)

(52) U.S. Cl. ..... 343/700 MS; 343/853; 343/702; 343/754

(58) Field of Classification Search ..... None
See application file for complete search history.

(56) References Cited

U.S. PATENT DOCUMENTS

| | | | | |
|---|---|---|---|---|
| 5,210,542 | A | 5/1993 | Pett et al. | |
| 5,835,057 | A | 11/1998 | van Heyningen | |
| 5,886,671 | A | 3/1999 | Riemer et al. | |
| 5,929,819 | A * | 7/1999 | Grinberg | 343/754 |
| 6,034,634 | A | 3/2000 | Karlsson et al. | |
| 6,166,705 | A | 12/2000 | Mast et al. | |

(Continued)

FOREIGN PATENT DOCUMENTS

EP 0 301 580 A 2/1989

(Continued)

OTHER PUBLICATIONS

European Patent Application No. 04718231.6 Examination Report dated Dec. 15, 2005.

(Continued)

*Primary Examiner*—Trinh V Dinh
(74) *Attorney, Agent, or Firm*—D. Kligler I.P. Services Ltd.

(57) ABSTRACT

An antenna system comprising a first multi-layer Printed Circuit Board having multiple antenna elements disposed thereon, at least a second multi-layer PCB, which is mounted below the first multi-layer PCB, and which comprises electronic components for processing Radio Frequency signals received by the antenna elements; and multiple RF transitions, which are mounted between the first and second multi-layer PCBs and are operative to transfer the RF signals from the first multi-layer PCB for processing by the electronic components in the second multi-layer PCB.

7 Claims, 5 Drawing Sheets

U.S. PATENT DOCUMENTS 6,191,734 B1 2/2001 Park et al.

FOREIGN PATENT DOCUMENTS

| | | | |
|---|---|---|---|
| EP | 0 886 336 | A | 12/1998 |
| WO | WO 99/66594 | A | 12/1999 |
| WO | 2004/079861 | A1 | 9/2004 |

OTHER PUBLICATIONS

European Patent Application No. 04718231.6 Examination Report dated Oct. 2, 2006.

European Patent Application No. 04718231.6 Summons to attend Oral Proceedings and Examination report dated Sep. 19, 2007.

European Patent Application No. 04718231.6 Examination Report dated Nov. 30, 2007.

European Patent Application No. 04718231.6 Summons to attend Oral Proceedings and Examination report dated Jan. 15, 2009.

Soon Ik Jeon et al.: "Active phased array antenna for mobile multimedia services via satellite", 2000 IEEE Aerospace Conference, vol. 5, Mar. 18, 2000, pp. 165-170, XP010517164.

* cited by examiner

FLAT MOBILE ANTENNA SYSTEM

This application is a U.S. National Stage application of co-pending PCT application PCT/BG2004/000003 filed Mar. 8, 2004, which was published in English under PCT Article 21(2) on Sep. 16, 2004, and which claims the priority of Bulgarian Patent Application No. 107620, filed Mar. 6, 2003. These applications are incorporated herein by reference in their entireties.

FIELD OF THE INVENTION

The presented invention concerns a flat antenna system, which could be used on moving vehicles and platforms to receive TV, Internet and other communication signals broadcasted from satellites.

PRIOR ART

The known mobile satellite antenna systems are with mechanical, electronic or combined—electro-mechanical tracking. The systems with purely mechanical tracking use directed antennas which are rotated mechanically toward the satellite direction, while these with electronic tracking form a directional radiating pattern in the needed direction. A suitable variant is to combine the mechanical tracking in azimuth plane with electronic tracking in elevation of the satellite.

Disadvantage of the known mobile antenna systems with combined electronic and mechanical tracking is that they have relatively big dimensions especially in height, what makes their use difficult on some types of vehicles, for instance passenger cars. Another drawback of these systems is their complicated structure, ensuring the necessary parameters of the system, however, in turn, resulting in comparatively high price. From U.S. Pat. No. 6,034,634 a solution is known, similar to the presented embodiments, which includes mechanical steering in azimuth and electronic tracking in elevation. The patent describes an antenna used in terminals working with LEO satellites comprising elevating platform, mounted so as to be able to be rotated accurately around a transverse to the rotational platform axis, which is rotated around a central axis. A plurality of antenna elements, forming a phased array antenna, are mounted on the elevating platform and have tracking plane parallel to and passing through the transverse axis of the elevating platform.

The antenna can be steered mechanically and electronically, and is used for switching from one to other LEO satellite by positioning of the elevating platform of the antenna with the perpendicular to its surface directed between the two satellites, so that the tracking plane of the antenna passes through the two satellites. At the moment of switching the antenna beam is electronically directed from one satellite to the other without loss of any communication data during this process.

Disadvantage of the solution is the necessity of additional mechanical tilting in elevation plane leading to further increase of the height of the system.

Other similar solution is shown in U.S. Pat. No. 5,886,671, where fully electronic steering is realized, which makes the structure more complicated and more expensive. The phased array antenna includes waveguide structure with a plurality of waveguides. The waveguide structure distributes the received or transmitted electromagnetic signals through the plurality of waveguides to a corresponding module of the active phased array, which amplifies and tunes the phase of the receiving signal. The active phased array modules are connected to an internal interconnecting structure, which provides paths for the signals to pass through, and paths for the supply and digital signals from and to the active phased array modules. The internal interconnecting structure and the waveguide structure are mounted to the platform to form a stable unit, so that the electronic modules to be supported in a predefined position with respect to the corresponding waveguides. The platform also contains waveguides for distribution of the electromagnetic signals from the internal interconnecting structure to the output of the antenna. Each active array module includes polarizing element for switching between left-hand and right-hand polarization. The polarizing element, the amplifiers and the phase control devices are mounted on a substrate in every active array module, while the substrate is mounted perpendicularly to the direction of the propagation of the signals in the corresponding waveguides which ensures the flat structure of the antenna.

From U.S. Pat. No. 5,835,057 a solution is known with fully mechanical tracking which uses a directed antenna with non-steering diagram.

The patent describes a mobile satellite communication system including an antenna assembly mountable on a vehicle and a satellite tracking assembly. The antenna assembly includes an antenna device for receiving first satellite signals from a first satellite in a first frequency band and for transmitting and receiving second satellite signals to and from a second satellite in a second frequency band, and a drive subassembly for rotating the antenna device relative to the vehicle in response to a control signal. The satellite tracking assembly maintains the antenna device pointed at the first and second satellites as the vehicle moves. The system further includes a receiver coupled to the antenna device for receiving the first satellite signals and a transceiver coupled to the antenna device for transmitting and receiving the second satellite signals Main drawback of such solution is the impossibility to build the system with low profile.

SUMMARY OF THE INVENTION

Objective of the presented invention is to create a mobile antenna system with simplified structure and minimized height, which provides the necessary properties for satellite receiving and tracking.

According to the invention the objective is accomplished with mobile antenna system comprising:

a part rotating by azimuth, representing an electronically steered in elevation phased array antenna, characterized by comprising:

a plurality of (multi)layered structures, placed at certain levels, comprising microstrip antenna elements, feeding lines, which appropriately combine and guide the electromagnetic energy, forming the necessary phase and amplitude distribution over the antenna elements, a plurality of electronic modules providing amplification, phase change, frequency conversion and steering of the received signal, power supply and control circuits for the same electronic modules;

a plurality of vertical transitions, providing the passing of the electromagnetic energy between the layered structures from different levels;

frequency converting device and rotary joint, passing the received signal, the power supply and control circuits to the static part;

sensors for detecting the spatial movement of the system, and power supply and control units;

static part, comprising bottom, cover with radiotransparent part, mechanical supports, motor, gear, plurality of electronic modules;

In a preferred embodiment the first layered structure forming the first level comprises the micro strip antenna elements.

In other preferred embodiment the microstrip antenna elements are cavity backed.

In other preferred embodiment the microstrip antenna elements are dual port.

In a preferred embodiment the microstrip antenna elements are probe fed.

In other preferred embodiment the microstrip antenna elements are slot fed.

In other preferred embodiment the microstrip antenna elements are tilted to the observation angle.

In other preferred embodiment the microstrip antenna elements are covered with dielectric layer, which could act as impedance matching for low elevation tracking.

In other preferred embodiment the dielectric layer could carry the antenna elements.

In other preferred embodiment the antenna elements are placed in a lattice formed from the peaks of isosceles triangles.

In a preferred embodiment the electronic tracking is in one plane perpendicular to the rows formed from one of the sides of the triangles, which form the lattice.

In other preferred embodiment the antenna elements placed in the rows, perpendicular to the electronic tracking plane, are placed at optimal distance regarding the effective utilization of the antenna aperture and feeding lines density.

In other preferred embodiment the antenna elements are placed apart in certain places of the array in order to place mechanical supports there.

In other preferred embodiment the first layered structure comprises feeding lines, which feed sequentially several antenna elements from one and the same row.

In other preferred embodiment the first layered structure comprises feeding lines, which feed in sequence and in parallel several antenna elements from one and the same row.

In other preferred embodiment the first layered structure comprises feeding lines, which feed in sequence and in parallel several antenna elements from neighboring rows providing constant phase difference between them.

In other preferred embodiment the levels are formed from more than one similar layered structure, so as to form a plurality of leveled modules, which are united from the lower levels.

In other preferred embodiment the leveled modules could be tilted to the direction of observation.

In other preferred embodiment the first layered structure is formed from vertically placed layers.

In other preferred embodiment the first layered structure contains low noise amplifiers.

In other preferred embodiment the next layered structure contains feeding lines, combining the groups from the first level and from one and the same row in parallel.

In other preferred embodiment the next layered structures contain amplifiers.

In other preferred embodiment the last layered structure also contains phase control devices.

In other preferred embodiment the last layered structure contains amplitude control devices.

In other preferred embodiment the phase control devices are integrated circuits.

In other preferred embodiment the phase control devices are built from discrete components.

In other preferred embodiment the last layered structure contains feed lines, forming circuit, which combines parts from the different rows.

In other preferred embodiment the last layered structure contains a plurality of digital control units for steering of amplitude and phase control units.

In a preferred embodiment the feed lines in the layered structures are microstrip lines.

In a preferred embodiment the feed lines in the layered structures are strip lines.

In a preferred embodiment at least some of the layered structures are multilayer printed circuit boards.

In a preferred embodiment at least some of the layered structures are fulfilled as equal modules containing one or more levels, united from the next level of layered structure.

In a preferred embodiment the connection between the feed lines from the separated levels is provided from plurality of vertical RF transitions.

In another preferred embodiment the vertical RF transitions are coaxial elements, capable for surface mounting.

In another preferred embodiment the vertical RF transitions are stripline elements, capable for surface mounting.

In another preferred embodiment the vertical RF transitions have supporting mechanical functions.

In another preferred embodiment one side of the layered structures is covered with electromagnetic absorptive coating.

In another preferred embodiment the RF outputs from the layered structure of the last level are connected through coaxial cables to a separate combiner.

In another preferred embodiment the output of the said combiner is connected with the input of the frequency converter.

In another preferred embodiment the leveled structure is covered with cover, which is an electromagnetic shield.

In another preferred embodiment the cover has electromagnetic absorptive coating from the inner side.

In another preferred embodiment the cover has supporting and carrying functions.

In another preferred embodiment the cover is mounted to the static part through rotary joint.

In another preferred embodiment the cover comprises mounted from beneath gear, passing the movement from the motor.

In another preferred embodiment the said gear is made as crown, around the periphery of the cover of the rotary part.

In a preferred embodiment the driving is provided by belt gear.

In a preferred embodiment the cover of the antenna system has radiotransparent part, which in a variant could have impedance matching properties for lower elevation tracking.

In a preferred embodiment the system has satellite signals reading and recognition unit.

The advantages of the antenna system according to the invention are its simplified from a technological point of view structure, giving an opportunity for realization of a system with low height, easier and cheaper production. The leveling of the structure allowed the feeding lines to be distributed in height, providing closer placement of the neighboring rows of antenna elements, which is extremely critical for the tracking parameters. On the other hand, the possibilities are avoided for mutual influence between long sequentially fed parts from the feeding lines, which minimizes the uncertainty of the phases, mutual coupling, possibility for blindness effect, etc.

DETAILED DESCRIPTION OF THE PREFERRED EMBODIMENTS

Figure 1:
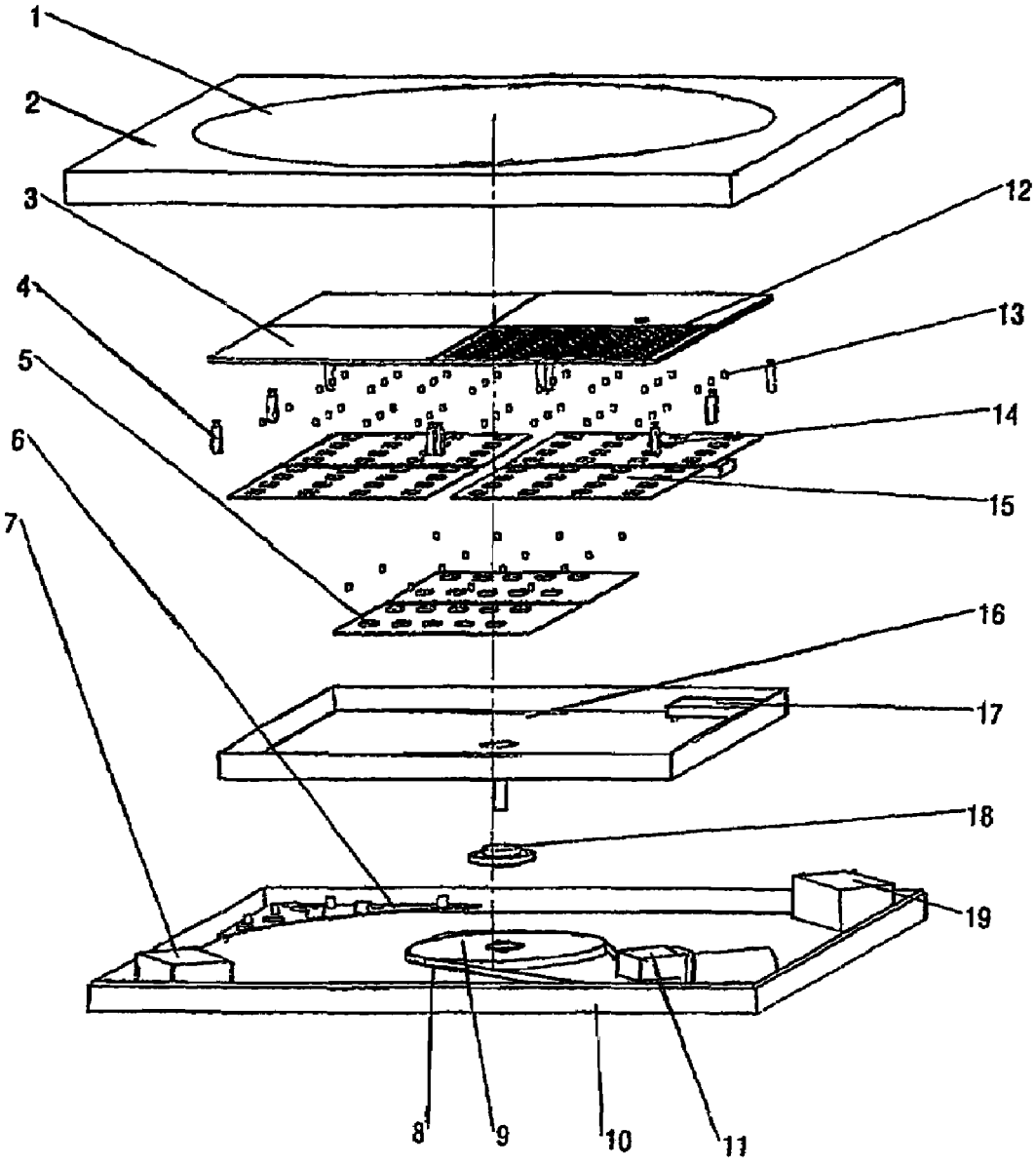
FIG. 1 shows exploded view of a preferred embodiment of the system.
Figure 2:
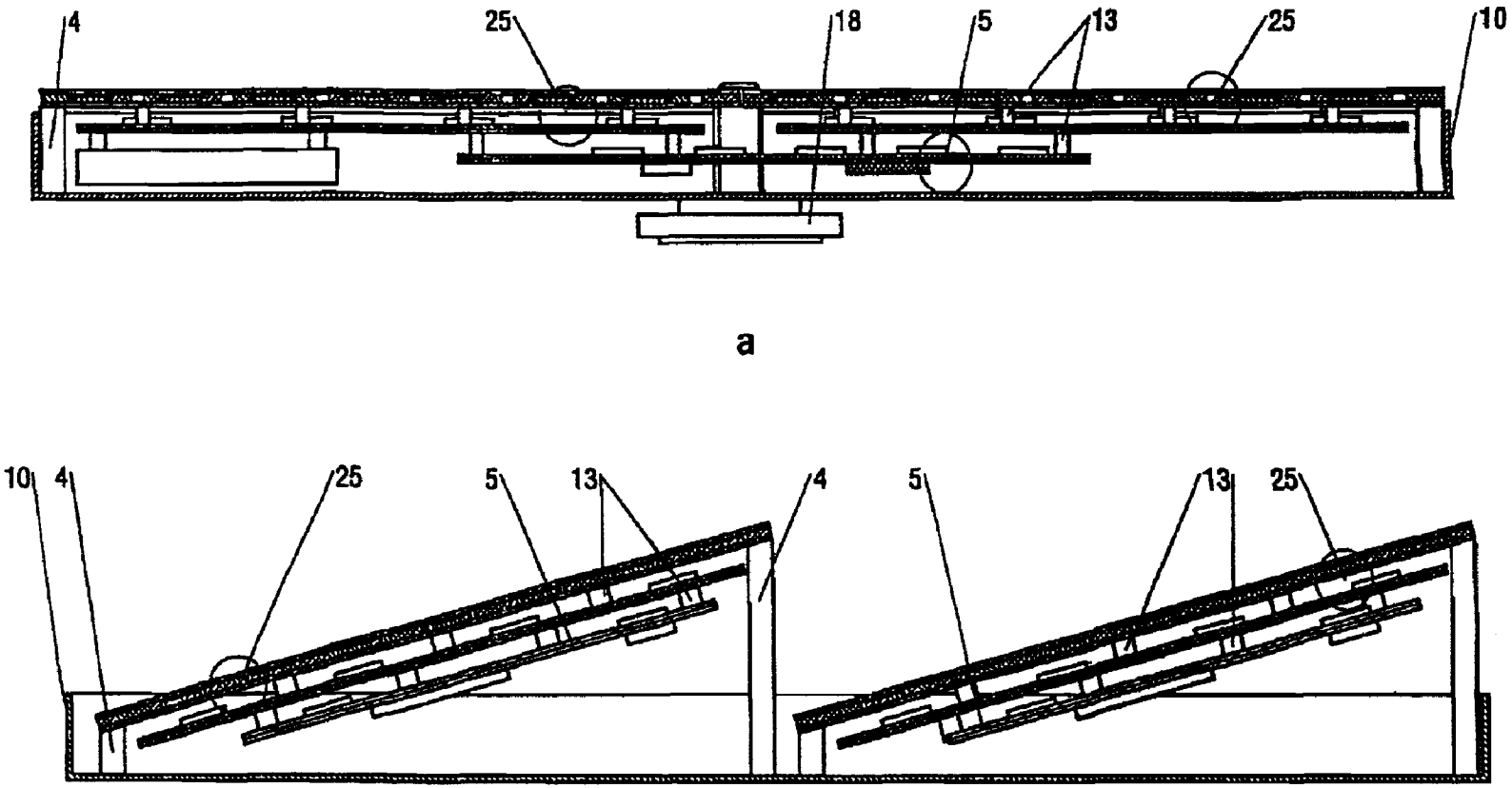
FIG. 2 shows cross-section of preferred embodiments of the antenna system.
Figure 3:
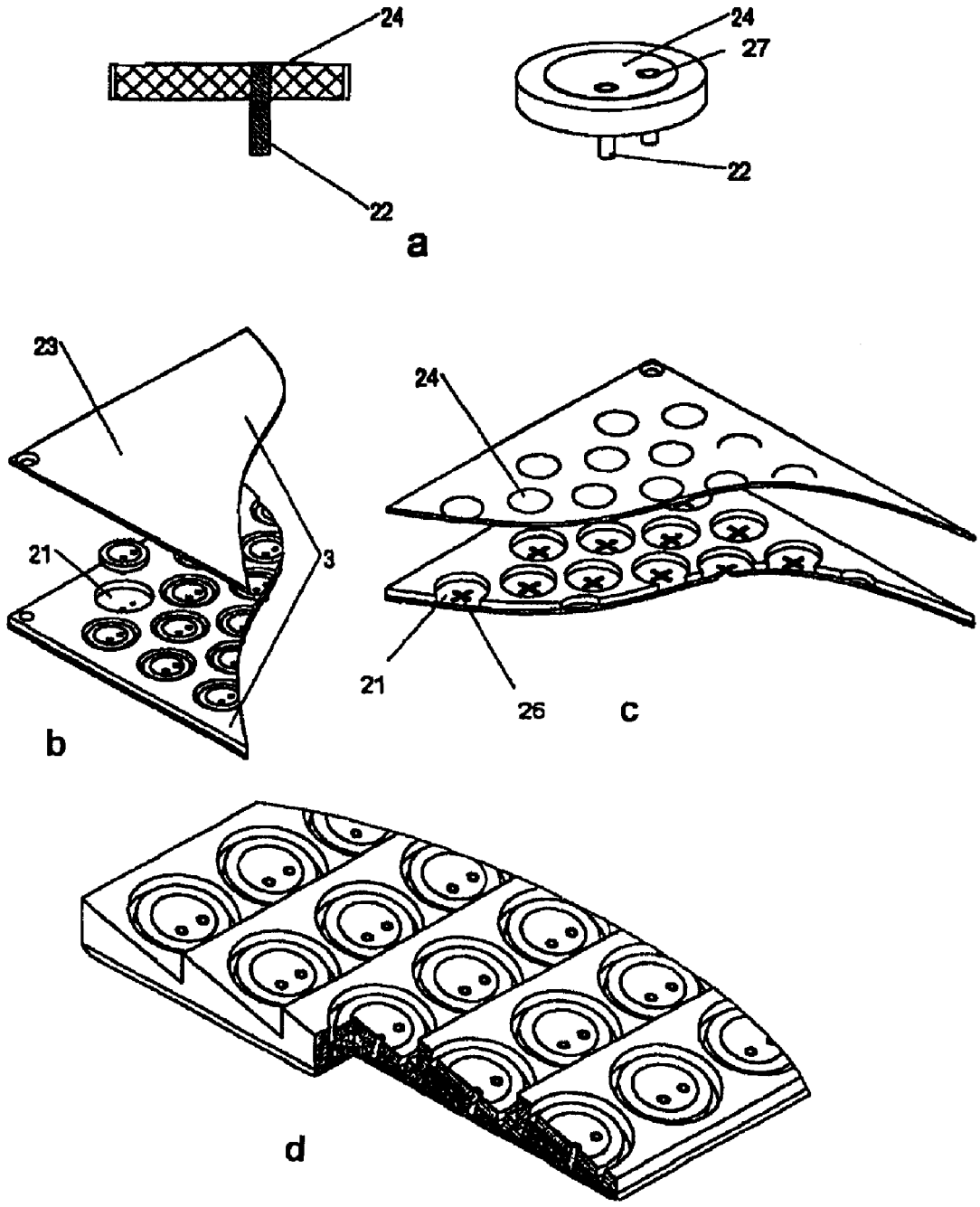
FIG. 3 shows preferred embodiments of the antenna elements.
Figure 4:
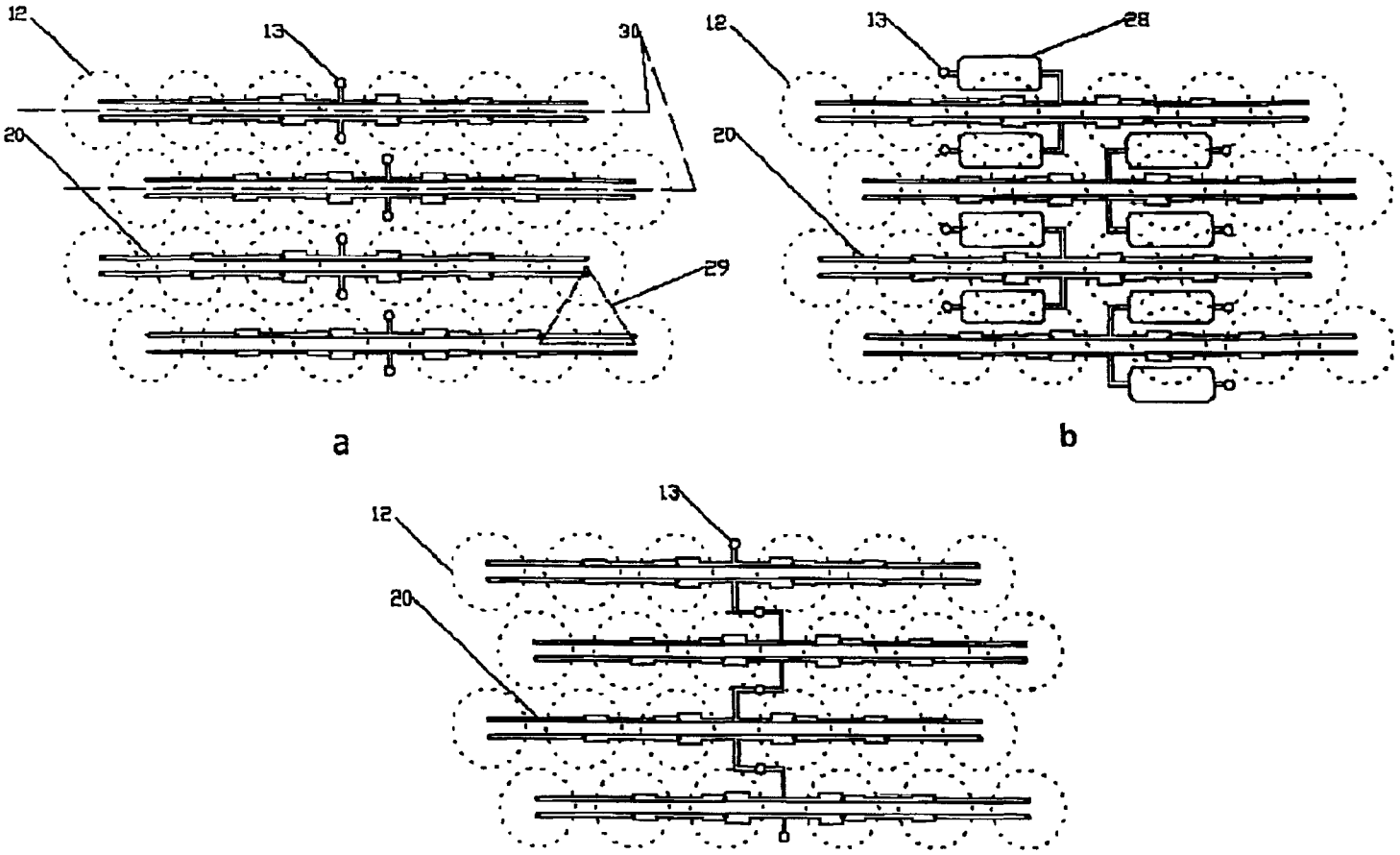
FIG. 4 shows preferred embodiments of the feeding lines of the first level.
Figure 6:
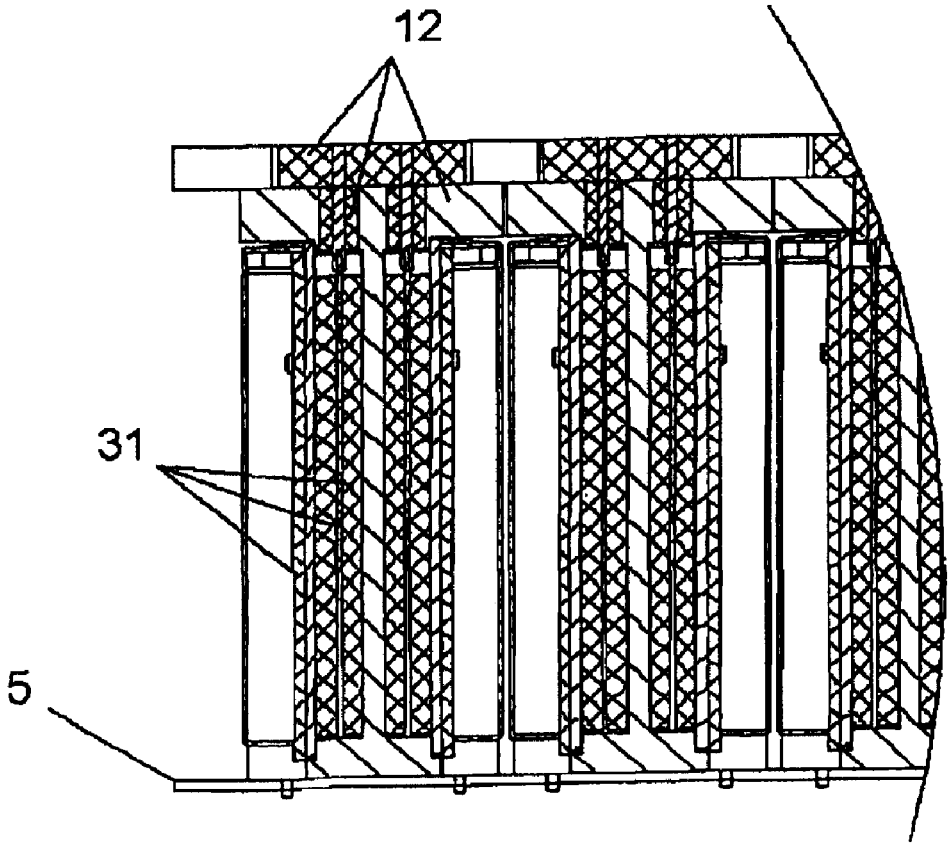
FIG. 6 shows cross section of a preferred embodiment of the antenna using vertical modules.

The Antenna system includes rotary and static parts. The static part is the box of the system, comprising bottom 10 (FIG. 1), cover 2, with radiotransparent part 1, microprocessor control unit 6, motor with motor controller 11, belt gear 8, providing the necessary properties of the driving, power supply module 7 and satellite recognition module 19. The rotary part is a steerable phased array, which is rotated in the horizontal plane around its geometric center, while with the steering of the rotation the azimuth tracking of the receiving signal is provided. The elevation tracking is provided electronically. The tracking is done according to a special algorithm, using information about the strength of the receiving signal and the spatial movement of the antenna array. The rotary part is comprised of a plurality of layered structures 3,5,15 (FIG. 1), building separate levels and including microstrip antenna elements 12, feeding transmission lines 20 (FIG. 4), which carry and combine the received from the antenna elements 12 signal in a suitable way according to the structure, so as to ensure the needed phase and amplitude relation between the antenna elements. On the corresponding levels several low noise amplifying stages 21 for each row are built, while the number and their places are selected with regard to ensuring the overall amplification and noise figure. On the last level of the structure phase control stages are placed, which provide the dynamic steering of the tracking beam. The layered structures consist of power supply lines and digital control circuits for the phase control devices. The RF signal is passed through the different levels of the structure through vertical RF transitions 13, especially developed as SMT components. Frequency converting module, transferring the signal on intermediate frequency, digital control of the phase control devices, and sensors for detection of the spatial movement around three geometric axes are also placed on the rotary part. The mounting to the static part is provided through rotary joint 18, which comprises rotating electrical contacts for control signals circuits, power supply and coaxial RF transition. The microstrip antenna elements 12 are placed on the upper side of the layered structures of the first floor. They are placed in cavities 21 (FIG. 3*b*), made in one of the layers of the layered structure 3, in order to assure lower mutual coupling between the elements, thus avoiding many harmful effects, deteriorating the parameters of the antenna during tracking with relatively low elevation angles. On the other hand, such antenna elements have lower profile and good efficiency, because they are air filled. The antenna elements have two inputs, providing all necessary polarizations, which makes the system universal. The feeding is passed with probes 22 (FIG. 3*a*), which provides good efficiency, while occupying minimum space on the feeding layer. Thus, maximum density of the elements and more space for the feeding lines are provided. It is possible to implement capacitive coupled probe fed elements, so that the feeding lines will be decoupled for DC and respectively the number of the decoupling components in the amplification stages 28 will be reduced. A preferred embodiment is shown on FIG. 3*a*, where the capacitive coupling is realized with the slot 27. Other embodiment which could save technological operations, is to feed the antenna elements only through slot 26 (FIG. 3*b*), which could be realized using some space occupied by the feeding lines on the first level. In order to improve the scanning and covering of lower elevation angles the antenna elements could be tilted towards the direction of the tracking (FIG. 3*d*) with more complicated configuration of the layer forming the cavities. The antenna elements are covered with thin matching layer 23, which acts as impedance matching layer for scanning with small elevation angles. From array point of view the elements are arranged in a lattice of isosceles triangles (29), and the distance between them is selected according to the pattern requirements for covering lowest elevations. The direction of the electronic tracking is perpendicular to one of the sides of the triangles. The distance between the elements placed along the same side could be optimized in respect to element number and overall occupied area. There are particular places of the array with larger spaces, provided for mechanical support of the separate structures. From structural point of view some of the said leveled structures are built as separate equal modules, united from their bottom level. The feeding lines 20, placed on the first level 3, combine sequentially the signal from corresponding inputs of several antenna elements 12, placed along the rows (30), perpendicular to the direction of the electronic tracing, forming basic groups from passively combined elements. Furthermore, two of the said groups are connected in parallel and the signal is passed through vertical RF transition 13 (FIG. 4*a*) to the next level, where the first amplification is realized. It is possible to combine more than two groups of sequentially fed elements, as in one embodiment (FIG. 4*c*) they could be from neighboring rows with corresponding phased difference implemented. With proper placement of the feeding lines the first amplification stage could be realized on the first level (FIG. 4*b*), as in this way the losses and the noise of the system are minimized. The first two levels 3,15 (FIG. 1) are built from four modules 25 (FIG. 2*a*), united two by two with the layer underneath 5, thus building two larger modules. In a preferred embodiment it is possible for so built modules to be tilted towards the direction of tracking in order to improve the tracking to lower elevation angles. In another embodiment (FIG. 6) the feeding lines from several layers (3, 15) could be routed on vertical layers 3, united from the last level 5, while each row of the array has it's own layered structure.

On the last level 5 parallel combining of the received signals by rows is realized, as well as the necessary number of amplification stages. The phase controlling stages, which steer the polarization and the elevation angle of the system are also placed there. For each row two phase control devices are provided, so that the number could be reduced with reduction of the number of the needed polarization to two circular or two linear. The phase control stages are standard phase shifting devices fulfilled as integrated circuits, but could be realized with discrete components. The outputs of the phase control devices of the corresponding structures are combined with combining circuit, formed by feeding lines with one output. They are digitally controlled from specially provided units connected with the CPU unit. The feeding lines are realized as microstrip lines on suitable substrates, while their material and thickness defines the density of the feed lines, which defines the number of the levels, and, hence, the complexity of the overall structure. In order to place the feed lines with higher density, a part of them could be realized as striplines, built as internal layers of the layered structures, using appropriate RF transitions. In essence, the said layered structures are printed circuit boards, fulfilled by standard technology. The assembling and mounting of all components is standard, as in most of the cases when SMT technology is used.

Figure 5:
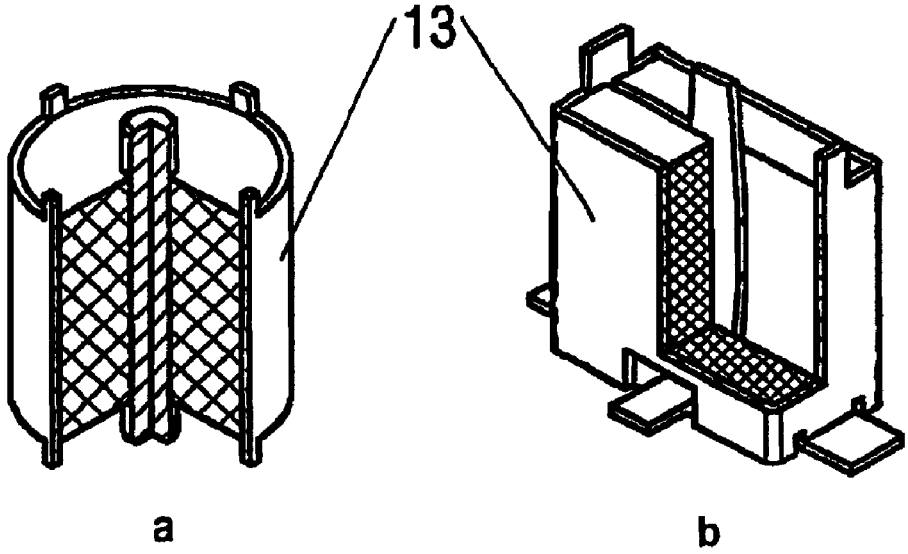
FIG. 5 shows preferred embodiments of the vertical transitions.

The separate levels are connected with a plurality of vertical RF transitions 13 (FIGS. 1,2,5), which pass the signal of the feed layers from level to level, as well as with the necessary number of mechanical supporting elements. The vertical transitions are developed for the particular application as coaxial transmission line or stripline. At one of their sides they are arranged for SMT mounting, and on the other side they have leads for passing through metalized through holes of the corresponding structure and are soldered to it.

The RF outputs of the structures from the last level 5 are united through coaxial cable in a final RF combiner, fulfilled as a separate module. From it the signal is passed to a frequency converter where it is transferred to an intermediate frequency and is passed to the output of the antenna through a module for receiving and recognition of the satellite signals.

The whole rotary part is enclosed by cover 10, which has supporting function, and provides electromagnetic shielding as well. Additionally, radio-absorptive layer is placed on the cover and the layered structures, which reduces the parasitic propagation of electromagnetic energy between the feeding lines. In the middle of the cover rotary joint 18 is mounted, comprising sliding joints, connecting the power supply circuit and these for the digital control, as well as coaxial rotary joint passing the RF signal.

On the bottom of the cover is mounted a specially built low profile tooth wheel, which is meshed with the driving belt and together with the gear ensures the necessary gear ratio of the driving. In a preferred embodiment this wheel could be fulfilled as crown, around the covers periphery, further reducing the antenna profile.

The antenna system acts as follows:

The electromagnetic signal, broadcasted from the satellite, is received by the antenna elements from the first level of the antenna system, after which it is carried and combined through the feeding lines, and on certain places amplifier stages are implemented, which ensures the necessary ratio of amplification/noise of the system. The combining is done basically in rows up to the phase control modules, and after them the rows are combined to one output for each module. The whole structure of feeding lines is with strictly controlled phase and amplitude ratios, which ensures quality steering of the tracking direction. The control of the phase control modules is fulfilled by a CPU unit, which provides software control of the tracking based on the measuring of the received signal and spatial movement sensors. This unit also performs the steering of the mechanical rotation of the rotary part, ensuring the tracking in azimuth plane.

APPLICATION OF THE INVENTION

The antenna system according to the invention is applicable in cases, when low profile mobile antenna is necessary for receiving satellite signals with different polarization on moving platform. The antenna system can work with conventional satellite receiver, while the steering could be realized by the receiver or from a separate control unit. The system can provide all contemporary services, broadcasted through GEO satellite, including digital TV reception or other equivalent digital data transfer. The high density of the rows ensures low elevation angles, which makes the system usable with equal success in wide geographic regions, for instance, the whole territory of the USA or Europe.

The invention claimed is:

1. An antenna system, comprising:

a first multilayer Printed Circuit Board (PCB), having multiple antenna elements disposed thereon;

at least a second multilayer PCB, which is mounted below the first multilayer PCB, and which comprises electronic components for processing Radio Frequency (RF) signals received by the antenna elements; and multiple RF transitions, which are mounted between the first and second multilayer PCBs and are operative to transfer the RF signals from the first multi-layer PCB for processing by the electronic components in the second multilayer PCB.

2. The system according to claim 1, wherein the antenna elements are tilted with respect to a plane of the first multilayer PCB.

3. The system according to claim 1, wherein the RF transitions comprise coaxial transitions.

4. The system according to claim 1, wherein the antenna elements comprise microstrip elements that are disposed in respective recesses in a top surface of the first multilayer PCB.

5. The system according to claim 1, wherein the electronic components comprise one or more phase shifters, one or more amplifiers and one or more combiners, which are respectively arranged to apply phase shifting, amplification and combining to the RF signals.

6. The system according to claim 5, wherein the electronic components are arranged to electronically steer a beam pattern formed by the antenna elements in an elevation plane by applying the phase shifting, amplification and combining, and comprising a mechanical rotation subsystem, which is arranged to rotate the first and second multilayer PCBs in an azimuth plane.

7. The system according to claim 1, wherein the second multilayer PCB has a top surface facing the first multilayer PCB, and wherein at least one of the electronic components is disposed on the top surface of the second multilayer PCB.

* * * * *